US007958825B2

(12) United States Patent
Lee et al.

(10) Patent No.: US 7,958,825 B2
(45) Date of Patent: Jun. 14, 2011

(54) SYSTEM AND METHOD FOR INTEGRATED STAGE SEPARATION

(75) Inventors: Thomas G. Lee, Oro Valley, AZ (US); Shek M. Cheung, Tucson, AZ (US); Gregory E. Longerich, Oro Valley, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 11/903,761

(22) Filed: Sep. 24, 2007

(65) Prior Publication Data

US 2009/0078145 A1 Mar. 26, 2009

(51) Int. Cl.
*F42B 15/10* (2006.01)

(52) U.S. Cl. ..... 102/377; 102/378

(58) Field of Classification Search ..... 102/377, 102/378

See application file for complete search history.

(56) References Cited

U.S. PATENT DOCUMENTS

| | | | | |
|---|---|---|---|---|
| 2,945,442 | A * | 7/1960 | Adelman et al. | 102/378 |
| 3,489,373 | A * | 1/1970 | Parilla | 244/3.15 |
| 3,656,304 | A * | 4/1972 | McCullough | 60/254 |
| 3,903,803 | A * | 9/1975 | Losey | 102/378 |
| 4,198,896 | A * | 4/1980 | Lamic et al. | 89/1.818 |
| 4,924,775 | A * | 5/1990 | Humphrey | 102/352 |

* cited by examiner

*Primary Examiner* — James S Bergin
*Assistant Examiner* — Daniel J Troy
(74) *Attorney, Agent, or Firm* — Schwegman, Lundberg & Woessner, P.A.

(57) ABSTRACT

A multi-stage vehicle separation system and method that facilitates an active separation on the booster by igniting a small quantity of propellant in the dead volume between the second stage rocket motor nozzle and the booster dome. In the most general embodiment, the invention includes a nozzle; a first fuel propellant disposed within the nozzle; a thermal barrier separating the first and second fuel propellant, an environmental seal protecting the second fuel propellant and an arrangement for activating the first fuel propellant. The nozzle is disposed in an upper stage of a two-stage vehicle. An arrangement such as a V-Band clamp is included for retaining the lower stage of the two-stage vehicle. Electronic commands release the lower stage and activate the first propellant in a timely manner to effectively separate the lower stage from the upper stage. The embedded propellant is activated with an arm fire device.

14 Claims, 2 Drawing Sheets

SYSTEM AND METHOD FOR INTEGRATED STAGE SEPARATION

BACKGROUND OF THE INVENTION

1. Field of the Invention

The present invention relates to aeronautics, astronautics and hydraulics. More specifically, the present invention relates to systems and methods for effecting separation between stages of multi-stage vehicles.

2. Description of the Related Art

Multi-stage vehicles are used in a variety of applications including space, aerospace, and hydrospace applications. Separation is typically achieved by either an active or a passive approach. Active approaches include the use of retro-rockets, explosives and/or mechanical arrangements (springs or other devices for storing energy). Passive approaches include arrangements for using drag to effect stage separation.

Unfortunately, the active approaches are typically somewhat complex, more costly and require considerably more space that passive approaches. Passive approaches, on the other hand, are beset by poor performance in designs where the upper stage has a diameter that is equal to or greater than that of the separating (lower) stage.

Hence, a need remains in the art for an improved system or method for separating stages of a multi-stage vehicle in flight that offers reliable performance without regard to the relative diameters of the stages and is space efficient, safe, simple and low in cost.

SUMMARY OF THE INVENTION

The need in the art is addressed by the multi-stage vehicle separation system and method of the present invention. In the most general embodiment, the invention includes a nozzle; a first fuel propellant disposed within the nozzle; and an arrangement for activating the first fuel propellant.

The nozzle is disposed in an upper stage of a two-stage vehicle. An arrangement such as a V-Band clamp is included for retaining the lower stage of the two-stage vehicle. Guidance commands release the lower stage and activate the first propellant in a timely manner to effectively separate the lower stage from the upper stage. The embedded propellant is activated with an arm fire device. Inasmuch as the nozzle is adapted to burn a second fuel propellant disposed external thereto, thermal insulation is provided between the embedded propellant and the upper stage fuel propellant as an optional safety measure.

Hence, the inventive system achieves an active separation on the booster by placing a small quantity of propellant in the dead volume between the second stage rocket motor nozzle and the booster dome.

DESCRIPTION OF THE INVENTION

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
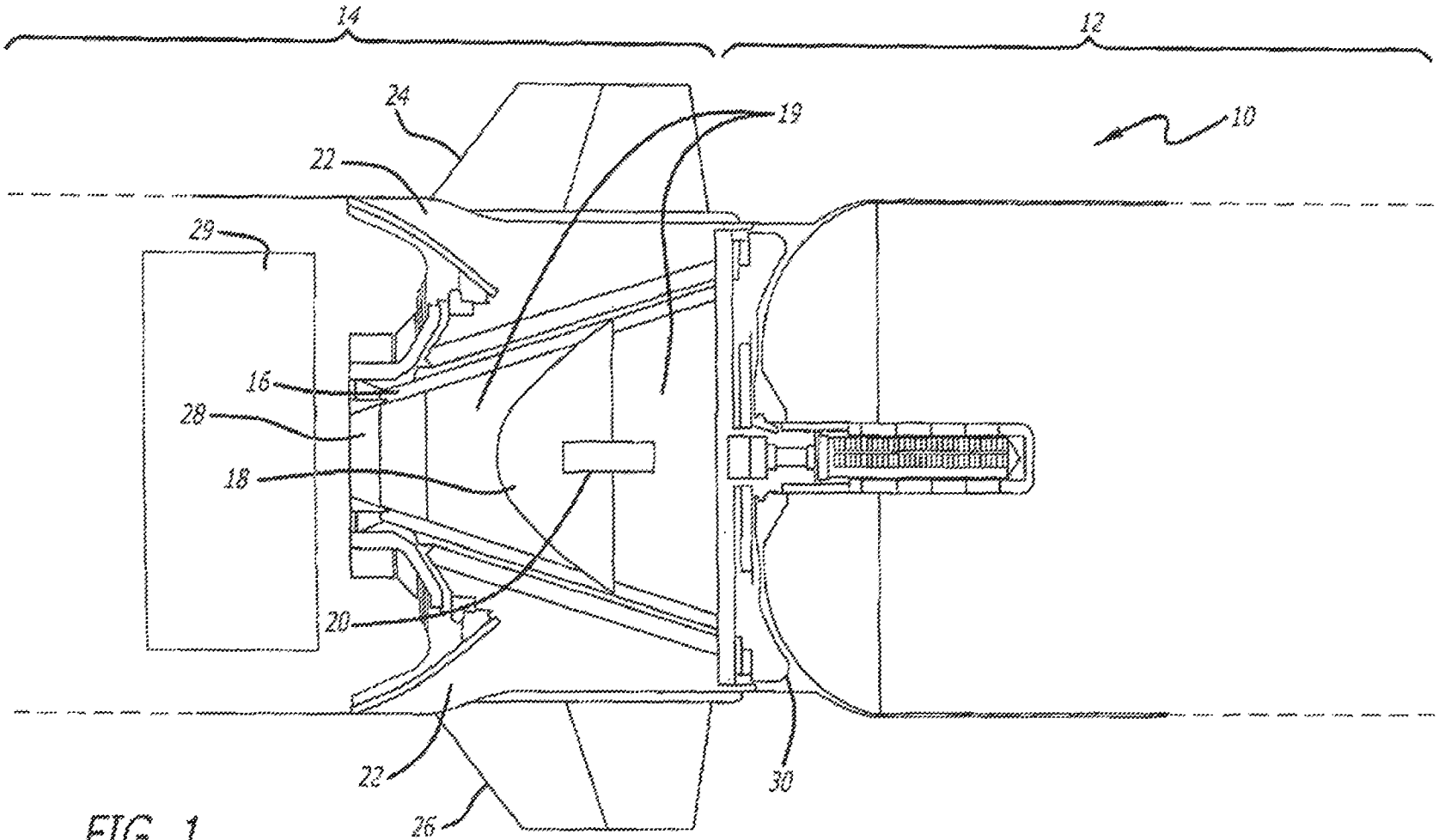
FIG. 1 is a simplified sectional side view of an illustrative embodiment of the multi-stage vehicle separation system of the present invention in a pre-separation condition thereof.

FIG. 1 is a simplified sectional side view of an illustrative embodiment of the multi-stage vehicle separation system of the present invention in a pre-separation condition thereof. As illustrated in FIG. 1, the multi-stage vehicle separation system 10 of the present invention includes a first lower stage 12 and a second upper stage 14. The upper stage 14 includes a nozzle 16. In accordance with the present teachings, a propellant 18 is embedded in the second stage nozzle volume 19 to effect stage separation. The embedded propellant 18 is ignited by a conventional arm fired device 20 on receipt of a signal from a steering control section 22 of a guidance system (not shown). The embedded propellant 18 may be any conventional propellant. In addition, the propellant may be ignited by a variety of wired or wireless fuses. Wired fused are preferred for safety reasons.

The second stage 14 has control surfaces 24 and 26 and a plug 28 to provide thermal insulation and an environmental seal between the embedded propellant 18 and a second propellant 29 disposed in the second stage 14 for propulsion thereof in a conventional manner. A V-Band clamp 30 serves to secure the lower stage 12 to the upper stage 14 in a conventional manner. The clamp 30 is released under the control of the guidance system prior to the activation of the embedded propellant 18.

Figure 2:
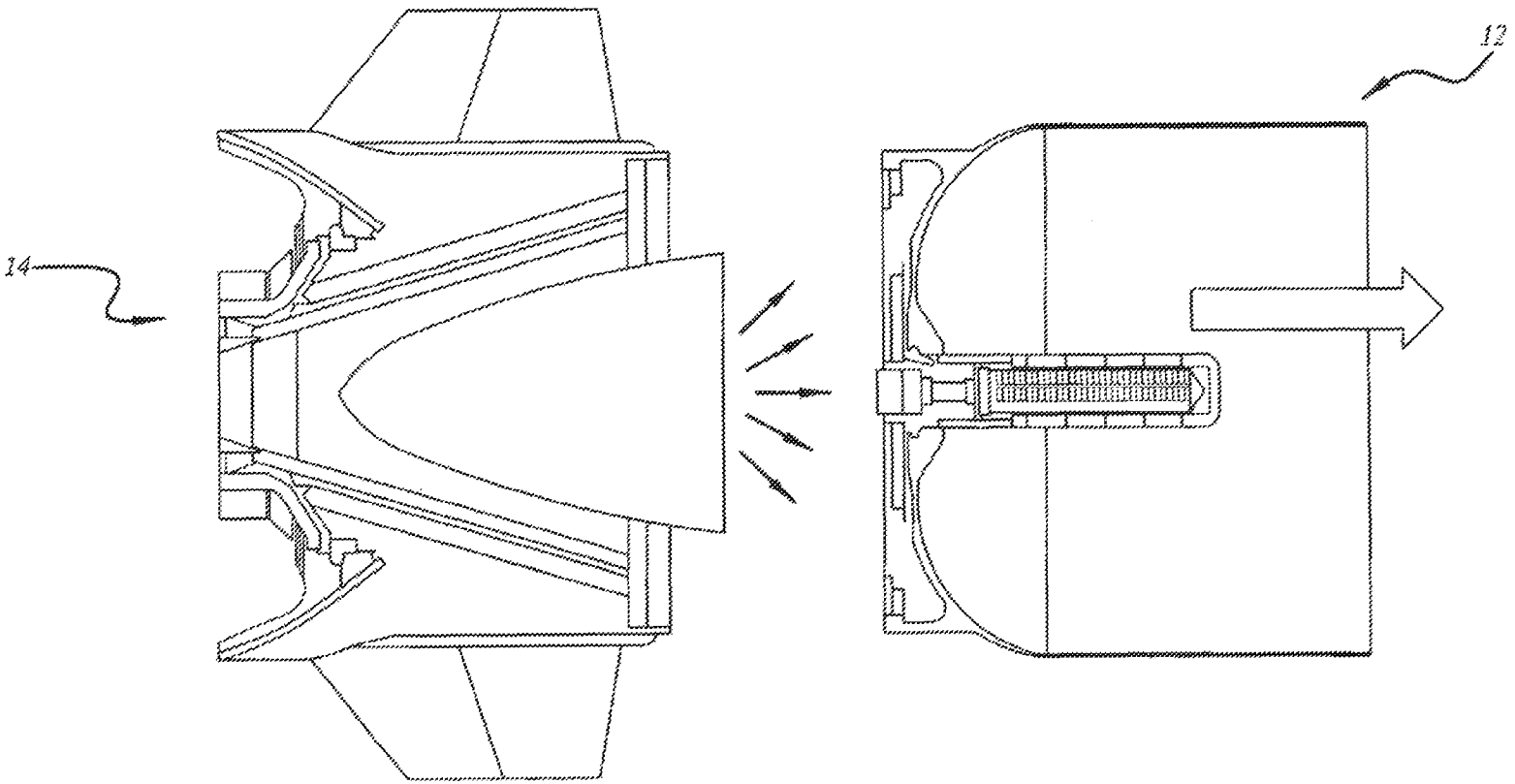
FIG. 2 is a simplified sectional side view of an illustrative embodiment of the multi-stage vehicle separation system of the present invention in a post-separation condition thereof.

FIG. 2 is a simplified sectional side view of an illustrative embodiment of the multi-stage vehicle separation system of the present invention in a post-separation condition thereof. When a conventional 'G-switch' (not shown) in the guidance system senses a drop in acceleration below a predetermined threshold, e.g., 1 g, the embedded propellant 18 is ignited. Hot gas and pressure generated by ignition of the embedded propellant in the second stage nozzle cavity exerts a force on the first stage booster 12 causing the first stage 12 to travel away from the second stage 14. The booster separation is equal to the force exerted on the booster divided by the mass of the spent booster 12. When the booster reaches a safe separation distance, the second stage motor ignition will occur per conventional practice.

Those skilled in the art will be able to determine how much propellant 18 to embed in the nozzle depending on the requirements of the application without undue experimentation.

Thus, the present invention has been described herein with reference to a particular embodiment for a particular application. Those having ordinary skill in the art and access to the present teachings will recognize additional modifications applications and embodiments within the scope thereof. For example, those of ordinary skill in the art will appreciate that the present teachings are not limited to two-stage vehicles. Moreover, the present teachings are not limited to vehicles adapted to fly in the air or in space. That is, the present teachings may be applied to vehicles in motion in any medium or a vacuum.

It is therefore intended by the appended claims to cover any and all such applications, modifications and embodiments within the scope of the present invention.

Accordingly,

What is claimed is:

1. A vehicle separation system for use in a multi-stage vehicle having a first stage and a second stage, said system comprising:

a first stage;

a second stage coupled to said first stage, wherein said second stage includes a first fuel propellant for pro elp said second stage, a combustion chamber for housing said first fuel propellant, and a nozzle coupled to said combustion chamber for expelling exhaust from said first fuel propellant;

a second fuel propellant embedded within a nozzle cavity of said nozzle external to said combustion chamber; and means for activating said second fuel propellant to separate said first stage from said second stage and expel said first stage from said vehicle prior to ignition of said first fuel propellant, whereupon on ignition of said first fuel propellant, said second stage is propelled.

2. The invention of claim 1 further including means for retaining said first stage of said vehicle.

3. The invention of claim 2 wherein said means for retaining includes a V-Band clamp.

4. A multi-stage vehicle comprising:

a first lower stage;

a second upper stage coupled to said first lower stage, wherein said second stage includes a first fuel propellant for propelling said second stage, a combustion chamber for housing said first fuel propellant, and a nozzle coupled to said combustion chamber for expelling exhaust from said first fuel propellant;

a second fuel propellant embedded in a nozzle cavity of said nozzle external to said combustion chamber; and means for activating said second fuel propellant in said nozzle cavity to separate said first lower stage from said second upper stage prior to ignition of said first fuel propellant.

5. A method for effecting separation of a multi-stage vehicle having a first lower stage and a second upper stage and a nozzle disposed in said second stage of said vehicle, including the steps of:

providing a multi-stage vehicle having a first stage and a second stage coupled to said first stage, wherein said second stage includes a first fuel propellant for propelling said second stage, a combustion chamber for housing said first fuel propellant, and a nozzle coupled to said combustion chamber for expelling exhaust from said first fuel propellant;

embedding a second fuel propellant within a nozzle cavity of said nozzle in said second stage of said vehicle external to said combustion chamber and activating said second propellant to separate said first stage from said second stage and expel said first stage from said vehicle prior to ignition of said first fuel propellant, whereupon on ignition of said first fuel propellant, said second stage is propelled.

6. A multi-stage vehicle comprising:

an upper stage rocket motor, wherein said upper stage includes a first fuel propellant for propelling said upper stage, a combustion chamber for housing said first fuel propellant, and a nozzle coupled to said combustion chamber for expelling exhaust from said first fuel propellant;

a lower stage rocket booster, wherein said lower stage is coupled to said nozzle end of said upper stage;

a second fuel propellant separate from said first propellant, wherein said second propellant is embedded in a nozzle cavity of said upper stage nozzle external to said combustion chamber such that activation of said second propellant causes said lower stage to separate from said upper stage; and an ignition device for activating said second fuel propellant in said nozzle cavity prior to ignition of said first fuel propellant.

7. The invention of claim 6 wherein said vehicle further includes a plug disposed within said upper stage for providing thermal insulation and an environmental seal between said first and second propellants.

8. The invention of claim 1 wherein said second fuel propellant is separate from and not in contact with said first fuel propellant.

9. The invention of claim 8 wherein said system further includes means for insulating said second fuel propellant from said first fuel propellant.

10. The invention of claim 9 wherein said means for insulating includes a plug disposed within said nozzle to provide an environmental seal between said second fuel propellant and said first fuel propellant.

11. The invention of claim 1 wherein said means for activating includes an ignition device.

12. The invention of claim 11 wherein said means for activating further includes a guidance system adapted to sense acceleration of said vehicle and activate said ignition device when said acceleration drops below a predetermined threshold.

13. The invention of claim 1 wherein said first fuel propellant is ignited after said second stage is separated from said first stage by a predetermined distance.

14. The invention of claim 1 wherein said second propellant includes an amount of propellant determined based on the force needed to effect separation of said first stage from said second stage.

* * * * *

UNITED STATES PATENT AND TRADEMARK OFFICE

CERTIFICATE OF CORRECTION

PATENT NO. : 7,958,825 B2
APPLICATION NO. : 11/903761
DATED : June 14, 2011
INVENTOR(S) : Thomas G. Lee et al.

It is certified that error appears in the above-identified patent and that said Letters Patent is hereby corrected as shown below:

In column 3, line 9, in Claim 1, delete “pro elp” and insert -- propelling --, therefor.

In column 3, line 53, in Claim 5, delete “chamber” and insert -- chamber; --, therefor.

Signed and Sealed this
Ninth Day of August, 2011

David J. Kappos

David J. Kappos
*Director of the United States Patent and Trademark Office*